United States Patent [19]

Muckerheide

[11] Patent Number: 5,012,805

[45] Date of Patent: May 7, 1991

[54] SURGICAL MASK BARRIER APPARATUS

[76] Inventor: Myron C. Muckerheide, 1018 Noridge Dr., Port Washington, Wis. 53074

[21] Appl. No.: 204,545

[22] Filed: Jun. 9, 1988

[51] Int. Cl.[5] ..... A62B 7/10

[52] U.S. Cl. ..... 128/205.28; 128/206.19

[58] Field of Search ..... 128/205.28, 206.19, 128/206.12, 206.16, 206.17, 863, 201.25, 205.27

[56] References Cited

U.S. PATENT DOCUMENTS

| | | | |
|---|---|---|---|
| 2,116,241 | 5/1938 | Heuman | 128/863 |
| 2,227,667 | 1/1941 | Panettiere | 128/863 |
| 3,170,461 | 2/1965 | Watts, Jr. | 128/863 |
| 3,216,415 | 11/1965 | Littleton | 128/206.17 |
| 3,288,138 | 11/1966 | Sachs | 128/863 |
| 3,800,516 | 4/1974 | Paluch | 128/205.28 |
| 4,323,063 | 4/1982 | Fisichella | 128/863 |
| 4,326,514 | 4/1982 | Eian | 55/DIG. 35 |
| 4,365,627 | 12/1982 | Wing | 55/DIG. 35 |
| 4,419,994 | 12/1983 | Hilton | 128/206.19 |
| 4,469,087 | 9/1984 | Kelman | 128/206.19 |
| 4,488,547 | 12/1984 | Mason | 128/206.19 |
| 4,530,706 | 7/1985 | Jones | 55/DIG. 35 |
| 4,627,431 | 12/1986 | Werjefelt | 128/201.25 |
| 4,726,365 | 2/1988 | Jablonski | 128/206.19 |

*Primary Examiner*—Edgar S. Burr
*Assistant Examiner*—Aaron J. Lewis

[57] ABSTRACT

A surgical mask barrier apparatus for preventing potentially infectious fluids from penetrating through a conventional surgical respiratory mask, which fluid could come in contact with the wearer or enter the respiratory passages of an individual wearing such a mask. The surgical mask barrier apparatus consists of a substantially non-porous formed shield worn in conjunction with a conventional surgical mask. The apparatus includes ridges which cooperate with the structual ridges of a conventional surgical respiratory mask so that air passages are formed therebetween to facilitate normal breathing of the wearer. The apparatus is secured in overlapping orientation to the conventional surgical mask and thus to the wearer through the use of a resilient band. The apparatus further includes elements for removing and detecting the presence of carbon dioxide and excessive levels of moisture which could promote transmission of such infectious fluids if not corrected.

17 Claims, 1 Drawing Sheet

SURGICAL MASK BARRIER APPARATUS

BACKGROUND OF THE INVENTION

The present invention relates in general to protection apparatuses used during surgical procedures, and in particular, to a surgical mask barrier apparatus which is used in cooperation with a conventional surgical respiratory mask. The apparatus serves to prevent hazardous liquid material such as (HIV) infected blood, among other potentially hazardous body fluids which typically splatter onto, or otherwise come in contact with, a surgical mask, from passing through a conventional surgical respiratory mask, which could then in turn enter the wearer's body through contact with the skin or be inhaled into the respiratory system of a wearer. Situations where individuals may come in contact with or be exposed to such infectious fluids range from invasive surgical procedures to dental procedures, and even include conventional everyday health care situations.

Historically, surgeons and all other operating room personnel have utilized respiratory masks made of a fibrous substantially porous material which were designed to prevent particulate matter emanating from the wearer of the mask from passing through the surgical mask and contaminating the patient, and at the same time, were intended to allow both oxygen and carbon dioxide to pass through the surgical mask during normal breathing by the wearer. While several of such conventional surgical respiratory masks have been designed to restrict the passage of very minute particulate, and to minimize fluid passing through the mask, few, if any, have been designed to completely prevent the passage of fluids. While use of a substantially non-porous protective mask was not previously crucial to protecting operating room personnel, such is no longer the case. Even though conventional surgical respiratory masks may reduce the likelihood of particulate being able to pass through the mask's material, few, if any, prevent fluid from passing through the mask due to either capillary action or suction applied to the surgical mask as the result of normal respiratory action of the wearer. The recent isolation of the Human Immunodeficiency Virus (HIV) in blood, together with other potentially hazardous body fluids, has necessitated that surgeons, other operating room personnel and health care professionals at large, be protected from infectious fluids and material emanating from the patient to the maximum extent possible. The potential for transmission of such infectious fluids is additionally present in the dental environment and accordingly protection may need to be given to dental office personnel. In spite of the existence of the (HIV) virus, as well as other infectious diseases which may be transferred by splattered blood, few, if any conventional products utilize a substantially non-porous shield, yet alone a surgical mask barrier apparatus which is used in cooperation with a conventional respiratory mask, which permits normal respiratory action by the wearer, and at the same time, provides for maximum protection from the splattering of potentially infected body fluids.

Conventional masks typically absorb contaminated liquid, such as blood splattered thereon during surgical procedures, as well as moisture which accumulates during normal breathing by the wearer of a surgical mask. The absorption of blood and the like thereby increases the potential for transmission of infection as normal capillary action of the mask and liquid splattered thereon causes the contaminated fluid to be transported therethrough, which may in turn, enter the wearer's blood stream through open cuts on the face which often result from shaving, abrasions upon the gums or through the wearer's respiratory passages.

When a conventional surgical respiratory mask accumulates moisture and becomes moist or wet, the potential for absorption and transmission of infectious material escalates. A wet mask may cause infectious or carcinogenic particulate matter which may otherwise be trapped by a conventional mask to pass through the mask via the accumulated moisture which serves as a transport mechanism. Accordingly, particulate and liquid on the surface of the mask may penetrate the fibrous construction of the mask and may enter into the wearer's system.

If an excessive amount of accumulated moisture forms upon the conventional mask the wearer will typically experience difficulty in breathing due to blockage of the mask. Such blockage will typically cause the wearer to exert more force during breathing to overcome the reduced airflow, which will in turn create suction forces upon the mask in addition to the normal capillary action of the mask and draw the contaminated liquid and particulate matter through the mask. Accordingly, the likelihood of contaminated particulate and liquid entering into the wearer's system is dangerously increased.

It is thus an object of the present invention to provide a surgical mask barrier apparatus which can be used in cooperation with a conventional surgical respiratory mask which can effectively isolate and protect the conventional respiratory mask from potential absorption of fluid which may be contaminated, and in turn, greatly reduce the potential of particulate migrating and remaining in and upon the conventional surgical respiratory mask, all of which will prevent the infectious material from entering into the wearer's system.

Another object of the present invention is to provide a surgical mask barrier apparatus which can detect when excessive amounts of accumulated moisture have condensed upon, or near the conventional surgical respiratory mask during cooperating use with the surgical mask barrier apparatus, so as to prevent potentially dangerous absorption into, and through, the conventional surgical respiratory mask.

It is further an object of the present invention to provide a surgical mask barrier apparatus which facilitates ease in breathing during cooperating use with a conventional surgical respiratory mask, and which can notify a wearer, or an observer, of potential breathing difficulties, through the use of a carbon dioxide absorption packet which changes color upon exhaustion of its absorbing capabilities, and which can be seen through the external surface of the apparatus.

It is additionally an object of the present invention to provide a surgical mask barrier apparatus which is ergonomically designed so as to facilitate comfort during functional use and cooperation with a conventional surgical respiratory mask.

It is also an object of the present invention to provide a surgical mask barrier apparatus which is inexpensive to manufacture, so as to induce those working with potentially hazardous fluid during surgical procedures to use such an apparatus.

These and other objects of the invention will become apparent in light of the present specification and drawings.

SUMMARY OF THE INVENTION

The present invention comprises a surgical mask barrier apparatus for preventing infectious hazardous materials such as (HIV) infected blood and other contaminated body fluids from penetrating through a conventional surgical respiratory mask. The surgical mask barrier apparatus is designed to cooperate with the conventional surgical respiratory mask of the type typically worn by medical personnel during surgical procedures. The cooperation of the apparatus and conventional surgical mask serves to shield the wearer from physical contact with the infectious hazardous materials which typically splatter onto a conventional surgical respiratory mask during invasive surgical procedures, dental procedures or everyday healthcare situations, and which would otherwise soak through the conventional surgical respiratory mask, and thereby infect the wearer with any virus, bacteria or carcinogens which may be carried by the contaminated body fluids.

The surgical mask barrier apparatus includes substantially non-porous shielding means having an internal side, and an external side which is oppositely positioned thereto. The internal side of the substantially non-porous shielding means is juxtaposed to the conventional surgical respiratory mask. The external side of the substantially non-porous shielding means is thus positioned in an exposed relationship to the potentially infectious hazardous materials which may emanate from a patient during a surgical or dental procedure or common physical examination. The substantially non-porous shielding means is designed to have an overall surface area which is greater than the surface area of the conventional surgical respiratory mask so that it enshrouds the entire exposed surface area of the underlying conventional surgical respiratory mask when the non-porous shielding means is in its cooperating position. Spacing means are operably associated with the substantially non-porous shielding means so as to provide an air passage between the conventional surgical respiratory mask and the internal side of the substantially non-porous shielding means when each are in their cooperating position. This air passage allows the entry of oxygen, as well as the exit of carbon dioxide during the normal breathing of a wearer. Positioning means are operably associated with the substantially non-porous shielding means so that the substantially non-porous shielding means can be retained in an effective cooperating position with the conventional surgical respiratory mask. When in its cooperating position, the substantially non-porous shielding means serves to prevent the infectious hazardous materials which may be present in the body fluids of a patient and which may be splattered upon, or come in contact with, the mask, from soaking through the conventional surgical respiratory mask, thereby protecting the wearer from the infectious hazardous materials.

In a preferred embodiment of the invention, the surgical mask barrier apparatus further includes carbon dioxide absorption means which are positioned between the internal side of the substantially non-porous shielding means and the conventional surgical respiratory mask. The carbon dioxide absorption means serve to absorb accumulated carbon dioxide which results from the exhaling during the normal respiratory action of such a wearer.

In this preferred embodiment of the invention, the carbon dioxide absorption means further includes an indication means which signals the exhaustion of the absorbing capabilities of the carbon dioxide absorption means. The carbon dioxide absorption means consists of soda-lime granules, and/or soda-lime in a powdered form, or may consist of any suitable absorption compound. When in a powdered form, the soda-lime is affixed to the interior surface of the non-porous shielding means.

The preferred embodiment of the invention further includes carbon dioxide absorption means in the form of packet means secured to the internal side of the non-porous shielding means. The packet means contains the soda-lime granules. The packet means has a multiplicity of inlets which allow air, and in turn, carbon dioxide to enter into the packet means. When the carbon dioxide enters into these packets it reacts with the soda lime and the carbon dioxide is absorbed.

In yet another embodiment of the invention, the surgical mask barrier apparatus further includes a moisture detection means which is operably positioned against the internal side of the substantially non-porous shielding means. The moisture detection means serves to detect and indicate excessive levels of accumulated moisture which may occur on, or near, the internal side of the substantially non-porous shielding means, and/or, within the conventional surgical respiratory mask. Such excessive levels of accumulated moisture may attract a multiplicity of particles on the surface of the conventional surgical respiratory mask and additionally may clog the porous material of the mask, and thereby induce deep breathing by the wearer of the conventional surgical respiratory mask in order to draw sufficient air through the mask. If this were to occur, such deep breathing would produce suction forces upon the mask which would supplement the inherent capillary action possessed by a wet mask and allow liquid and particulate infectious hazardous materials which may have accumulated upon the conventional surgical respiratory mask to be transported through the mask, and in turn, onto the skin or into the respiratory track of the wearer, thereby potentially causing infection.

The moisture detection means can consist of adhesive backed strips so that its removal and replacement can be easily achieved. In addition, the moisture detecting means will change color when excessive levels of moisture have accumulated thereby providing to an observer, or to the wearer himself a visual indication that excessive levels of moisture have accumulated and that the mask should be replaced.

To further prevent the accumulation of excessive moisture, a desiccant may be utilized to absorb some of the moisture which normally accumulates as a result of the wearer exhaling moist air. A desiccant may be contained within the carbon dioxide absorption means or may be saturated into the material of which the shielding means is constructed.

In yet another embodiment of the invention, air velocity intensifying means are positioned juxtaposed to the internal side of the substantially non-porous shielding means. The air velocity intensifying means serve to force the exhaled air emanating from the wearer of the apparatus out of the air passages in an expeditious manner and promote circulation of fresh air into the mask to thereby facilitate ease in breathing. The air velocity intensifying means consist of helical shaped channel elements formed into the shielding means. When normal breathing occurs, air will travel around the internal channels of the helical shaped elements increasing the velocity of the air passing through and increasing air circulation. In addition, the air velocity intensifying means reciprocate towards and away from the underlying conventional surgical mask as the wearer breathes. The reciprocation results from the helical channel structure and serves to create a pumping action to promote the circulation of fresh air into the mask.

In the preferred embodiment of the invention, the surgical mask barrier apparatus further includes a substantially non-porous shielding means which is formed of a substantially transparent material so as to permit visual inspection of the carbon dioxide absorption means, as well as the moisture detecting means located thereunder. Such visual observation is necessary to ascertain the exhaustion of the carbon dioxide absorption means, as well as to determine if excessive levels of moisture have accumulated. Such an observation can then serve to signal the need to change masks, or make the appropriate alterations necessary to continue functional use thereof. Of course, an opaque or semi-opaque shielding means having a transparent window portion adjacent the carbon dioxide absorption and moisture detection means could be utilized.

The substantially non-porous shielding means is made of polypropinate, polycell urethane foam, vinyl, polystyrene or polycarbonate plastic. Where a polycell urethane foam is utilized to form the shielding means, the foam may itself be saturated with a desiccant, such as silica gel to absorb moisture which would otherwise accumulate on or about the conventional surgical mask thereby minimizing the problems associated with excessive moisture.

In the preferred embodiment of the invention, the substantially non-porous shielding means is formed in substantially the same shape as the conventional surgical respiratory mask. Such a configuration allows for the non-porous shielding means to be operably juxtaposed with the underlying conventional respiratory surgical mask.

The spacing means in the preferred embodiment of the invention, consist of ridge means which are formed into the substantially non-porous shielding means. These ridge means cooperate and align with the structural ridges of a conventional surgical respiratory mask so as to form air passages and facilitate operable positioning of the surgical mask barrier apparatus during cooperating use with the conventional surgical respiratory mask.

In the preferred embodiment of the invention, the positioning means comprise a resilient band which has a first end and a second end. Each of these ends are respectively affixed to opposite positions located near the periphery of the external surface of the substantially non-porous shielding means. The resilient band can be stretched and placed around the wearer's head, and over the conventional surgical respiratory mask, so as to retain the substantially non-porous shielding means in an operable juxtaposed position with the conventional surgical respiratory mask.

DETAILED DESCRIPTION OF THE DRAWINGS

Figure 1:
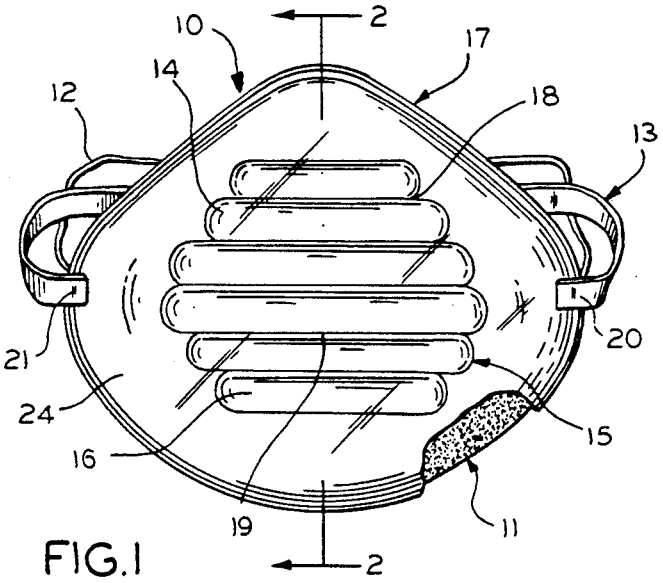
FIG. 1 of the drawings is an elevated front view of the surgical mask barrier apparatus shown in partial cutaway, particularly showing a conventional surgical respiratory mask which is completely shielded by the substantially non-porous shielding means, as well as the surgical mask barrier apparatus' positioning means.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Surgical mask barrier apparatus 10 is shown in FIG. 1 as including substantially non-porous shielding means 17, spacing means 15, and resilient band 13. Substantially non-porous shielding means 17 is shown partially cutaway, so as to reveal conventional surgical respiratory mask 11. As can be seen, substantially non-porous shielding means 17 has an overall surface dimension greater than that of conventional respiratory mask 11 so as to completely enshroud the underlying conventional surgical respiratory mask 11 from exposure to potentially hazardous, materials. Also shown as part of conventional surgical respiratory mask 11 is band 12, which is used to position and secure conventional surgical respiratory mask 11 upon a wearer. Resilient band 13 of surgical mask barrier apparatus 10, is used to secure the apparatus in its protective enshrouding position during functional cooperating use with conventional surgical respiratory mask 11, by manually stretching resilient band 13 over and around the wearer's head. Resilient band 13 has two opposite ends 20 and 21 which are oppositely affixed to periphery of external side 24 of substantially non-porous shielding means 17 in a bonded manner. Fusing obviates the need to puncture the surface of the substantially non-porous shielding means 17, thereby precluding the possibility of seepage of contaminated fluid at such a puncture. Substantially non-porous shielding means 17 is also designed with spacing means 15 which are comprised of ridges having high points, such as high points 14 and 16, as well as low points, such as low points 18 and 19. When in cooperating use with conventional surgical respiratory mask 11, spacing means 15 cooperate with ridges 35 and serve to create air passages, such as air passage 27, as seen in FIG. 2, between substantially non-porous shielding means 17 and conventional surgical respiratory mask 11, also as seen in FIG. 2.

Figure 2:
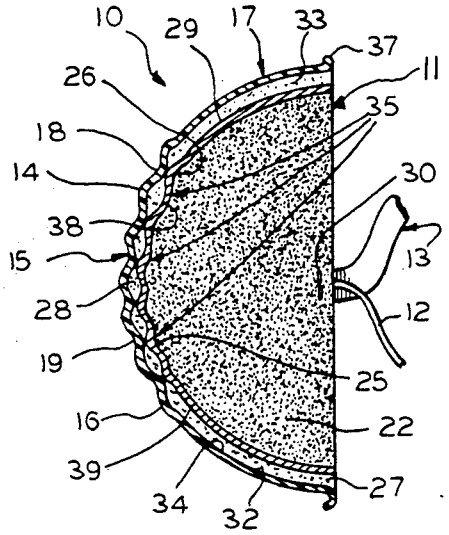
FIG. 2 of the drawings is an elevated cross-sectional side view taken along lines 2—2 of FIG. 1 and looking in the direction of the arrows, and showing the cooperation of the spacing means of the substantially non-porous shielding means with the structural ridges of the conventional surgical respiratory mask and the air passages created therebetween.

Surgical mask barrier apparatus 10 is shown in cross-sectional side view in FIG. 2, showing the position of the surgical mask barrier apparatus 10 in cooperation with conventional surgical respiratory mask 11. Spacing means 15 of substantially non-porous shielding means 17, cooperate with structural ridges 35 on top surface 29 of conventional surgical respiratory mask 11, so as to provide for the flow of air through air passages, such as air passages 27 and 28, which are formed between substantially non-porous shielding means 17 and conventional surgical respiratory mask 11, which in turn, allow for the inlet of oxygen and the outlet of carbon dioxide during normal respiratory action of wearer. Air passages 28, are achieved by the low points 18 and 19, of spacing means 15 of substantially non-porous shielding means 17, abutting high points 26 and 25 respectively, of structural ridges 35 of conventional surgical respiratory mask 11, which in turn causes high points such as 14 and 16 of spacing means 15, to be oppositely positioned to low points 38 and 39 respectively, of structural ridges 35 of conventional surgical respiratory mask 11. As a result, internal side 34 of substantially non-porous shielding means 17 will be distally located away from external top surface 29 of conventional surgical respiratory mask 11, so as to facilitate the passage of air therebetween. The wearer's ability to breath through surgical mask barrier apparatus' 10 is further enhanced by applying powdered carbon dioxide absorption means 32 to internal side 34 of substantially non-porous shielding means 17. Such an application will thereby serve to absorb exhaled carbon dioxide and limit the amount of carbon dioxide which is inhaled back into the wearer's respiratory system. Substantially non-porous shielding means 17 is shown saturated with a desiccant 33 which serves to absorb moisture which may accumulate on or about mask 17.

Resilient band 13 having opposite ends 20 and 21, as shown in FIG. 1, are also shown in FIG. 2. Band 12, of conventional surgical respiratory mask 11 is also shown, wherein it can be seen that the end of band 12 is affixed by a staple 30 to the porous material 22 of conventional surgical respiratory mask 11 for securing band 12 thereon. Such a method of securement increases the potential danger of splashing hazardous materials from passing through conventional surgical respiratory mask 11, and in turn, into a wearer's respiratory track, if the conventional surgical respiratory mask 11 is used without the protective shielding 17 of surgical mask barrier apparatus 10, as shown in FIG. 1. Also shown in FIG. 2 is a lip 37 formed at the periphery of the external surface 24, as shown in FIG. 1, of substantially non-porous shielding means 17, so that fluid splashed on to external surface 24 will not inadvertently find its way to internal side 34 of substantially non-porous shielding means 17, and/or in contact with the wearer. Lip 37 additionally makes the apparatus more comfortable to wear by eliminating sharp edges which would otherwise contact the skin.

Figure 3:
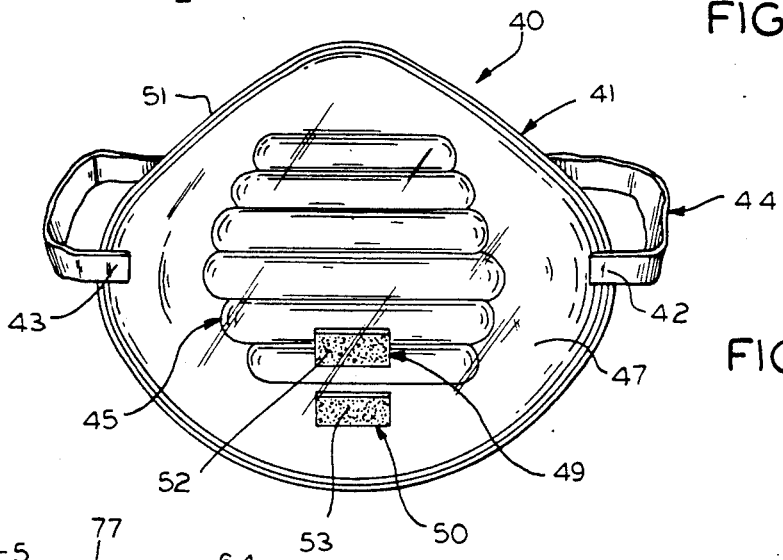
FIG. 3 of the drawings is an elevated front view of the surgical mask barrier apparatus showing, in particular, the carbon dioxide absorption means, as well as the moisture detecting strip, which are both positioned on the internal side of the substantially non-porous shielding means, and visible through the substantially transparent material of the substantially non-porous shielding means.

In FIG. 3, surgical mask barrier apparatus 40 is shown comprising substantially non-porous shielding means 41 which is substantially transparent, spacing means 45, carbon dioxide absorption packet 49, moisture detecting strip 50, and resilient band 44. Carbon dioxide absorption packet 49, as well as moisture detecting strip 50 are positioned upon internal side 51 of substantially non-porous shielding means 41. Both carbon dioxide absorption packet 49 as well as moisture detecting strip 50 are shown affixed using adhesive means 52 and 53 respectively. When carbon dioxide absorption packet's 49 absorbing capabilities have become exhausted, a noticeable change in color in the packet 49 will occur. Such a change in color can be viewed by an observer, or the wearer, through the substantially transparent non-porous shielding means 41, thereby notifying the wearer that correction of the condition is necessary. Moisture detection strip 50 will also change colors if excessive amounts of moisture accumulate on the moisture detection strip 50. Such a change in color serves to warn an observer, or the wearer of surgical mask barrier apparatus 40, that conventional surgical respiratory mask should be changed and that surgical mask barrier apparatus 40 should be replaced.

Resilient retaining band 44 is shown having two opposite ends 42 and 43 which are bonded to outer periphery of external surface 47 of substantially non-porous shielding means 41. This method of attachment is used instead of stapling, so as to eliminate any potential for passage of fluid through substantially non-porous shielding means 41. Resilient band 44 can then be stretched and secured about head of wearer of said surgical mask barrier apparatus 40.

Figure 4:
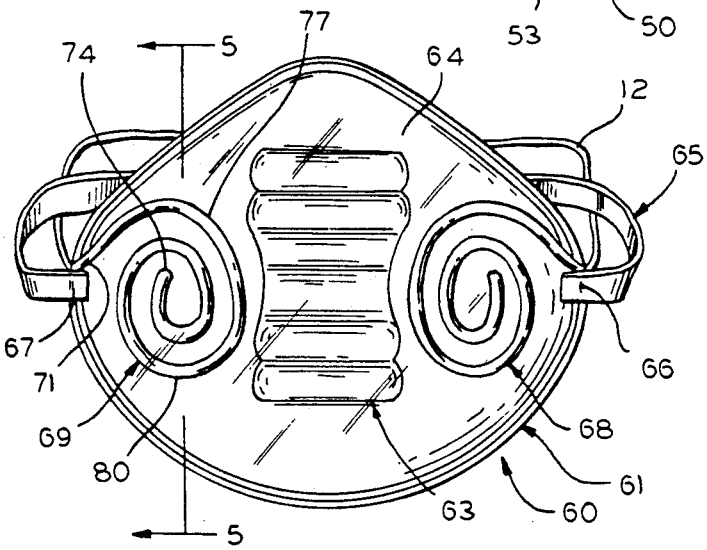
FIG. 4 of the drawings is an elevated front view of the surgical mask barrier apparatus shown in cooperation with a conventional surgical respiratory mask, and showing in particular, air velocity intensifying means.
Figure 5:
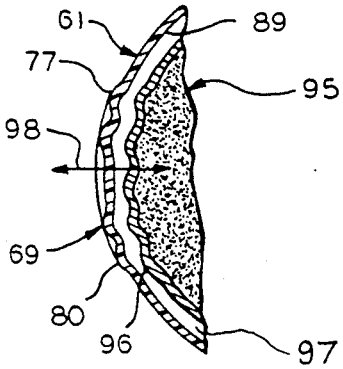
FIG. 5 of the drawings is an elevated cross-sectional side view taken along lines 5—5 of FIG. 4 and looking in the direction of the arrows, and showing the air channels of the air velocity intensifying means, as well as the air passage maintained between the substantially non-porous shielding means and the conventional surgical respiratory mask.

Surgical mask barrier apparatus 60 having substantially non-porous shielding means 61, air velocity intensifying means 68 and 69, and spacing means 63, is shown in FIG. 4. Air velocity intensifying means 68 and 69 are shown as helical channels formed into non-porous shielding means 61 and are positioned on opposite sides of spacing means 63. Air velocity intensifying means 69 is shown having air inlet and outlet orifices 71 and 74, located at each end of the helical formation, so as to allow the entry of oxygen and the escape of carbon dioxide through the flow into and out of, the air velocity intensifying means 68 and 69, and in turn, into and out of air passage 97 located between conventional surgical respiratory mask 95 and substantially non-porous shielding means 61, as shown in FIG. 5. Air velocity intensifying means 68 and 69 cause promote and increase the velocity of air flow within air passage means 97, shown in FIG. 5, through normal respiratory action of wearer. When the wearer inhales and exhales in normal fashion, air is sucked into and forced out of, respectively, inlet and outlet orifices, 71 and 74. The speed of the air flow is increased as a result of action of the air within internal channels, 77 and 80, of the helically shaped air velocity intensifying means 68 and 69.

External side 64 of substantially non-porous shielding means 61, has a surface area greater than the external surface area of conventional surgical respiratory mask 95, as shown in FIG. 5, so as to provide complete protective enshrouding of conventional surgical respiratory mask 95, thereby preventing hazardous materials from entering upon, and in turn, to pass through conventional surgical respiratory mask 95, as shown in FIG. 5. Surgical mask barrier apparatus 60 is secured in its cooperating position with conventional surgical respiratory mask 95, as shown in FIG. 5, and upon a wearer, by the use of resilient band 65 which has two opposite ends 66 and 67, each of which are affixed to the periphery of external surface 64 of substantially non-porous shielding means 61. Opposite ends 66 and 67 of resilient band 65 are bonded to external surface 64 of substantially non-porous shielding means 61 so as to eliminate the need to puncture the substantially non-porous shielding means 61. Also shown in FIG. 4, is retaining band 12 of conventional surgical respiratory mask 95, as shown in FIG. 5, which is used to secure conventional surgical respiratory mask 95 upon a wearer's head.

Internal channels, such as internal channels 77 and 80, of helical shaped air velocity intensifying means 69, are shown in cooperation with conventional surgical respiratory mask 95 in cross-section in FIG. 5. As air is moved through air passage means 97, which is formed between internal side 89 of substantially non-porous shielding means 61 and external surface 96 of conventional surgical respiratory mask 95, by normal respiratory action of wearer, air is forced to enter into internal channels, such as internal channels 77 and 80, through air inlet and outlet orifices, such as air inlet and outlet orifices 71 and 74, as shown in FIG. 4. Normal respiratory action of wearer further imparts a reciprocating motion as indicated by arrow 98 upon air velocity intensifying means 68 and 69 wherein air is alternately forced out of and drawn into air passage 97. Such reciprocating motion enhances the flow of air through internal channels, such as internal channels 77 and 80, as shown in FIG. 4, thereby increasing velocity of air as compared to the normal expulsion of air which would occur absent such air velocity intensifying means 69.

The foregoing description and drawings merely explain and illustrate the invention and the invention is not limited thereto, except insofar as the amended claims are so limited as those skilled in the art who have the disclosure before them will be able to make modifications and variations therein without departing from the scope of the invention.

What is claimed is:

1. A surgical mask barrier apparatus for preventing infectious hazardous material such as HIV infected blood, and other contaminated body fluids from penetrating through a cup-shaped conventional surgical respiratory mask wherein said surgical mask barrier apparatus cooperates with said conventional surgical respiratory mask of the type worn by medical personnel during surgical procedures, said apparatus shielding the underlying conventional surgical mask, and in turn, the wearer from contact with infectious hazardous material which typically splatter onto a conventional surgical respiratory mask during invasive surgical procedures and which would otherwise soak through said conventional surgical respiratory mask thereby infecting the wearer with any virus, bacteria or carcinogen carried by said contaminated body fluids, said surgical mask barrier apparatus comprising:

separate, substantially non-porous shielding means that abuts but is not affixed to said conventional surgical respiratory mask and having an internal side and an external side opposite to said internal side, said internal side of said substantially non-porous shielding means juxtaposed to said conventional surgical respiratory mask, wherein said external side of said substantially non-porous shielding means is positioned in exposed relationship to the source of said infectious hazardous materials, said substantially non-porous shielding means having substantially the same pre-formed cup-shape and contour as said conventional surgical respiratory mask so as to facilitate the juxtaposition of said conventional surgical respiratory mask with said substantially non-porous shielding means, said substantially non-porous shielding means further having an overall surface dimension greater than that of said conventional surgical respiratory mask so as to completely enshroud said conventional surgical respiratory mask when said non-porous shielding means is positioned juxtaposed thereto;

spacing means operably associated with said substantially non-porous shielding means for providing air passages between said conventional surgical respiratory mask and said internal side of said substantially non-porous shielding means when juxtaposed thereto, towards allowing the entry of oxygen and the exit of carbon dioxide during normal breathing of the wearer;

carbon dioxide absorption means operably positioned between said internal side of said substantially non-porous shielding means and said conventional surgical respiratory mask, said carbon dioxide absorption means serving to absorb accumulated carbon dioxide;

positioning means operably associated with said substantially non-porous shielding means for retaining said substantially non-porous shielding means in juxtaposed orientation to said conventional surgical respiratory mask, said substantially non-porous shielding means thereby cooperating with said conventional surgical respiratory mask, to, in turn, prevent said infectious hazardous materials from contacting and soaking through said conventional surgical respiratory mask to, in turn, protect said wearer from said infectious hazardous materials.

2. The invention according to claim 1 in which said carbon dioxide absorption means further includes indication means for signaling the exhaustion of the carbon dioxide absorbing capabilities of said carbon dioxide absorption means.

3. The invention according to claim 1 in which said carbon dioxide absorption means comprises of soda-lime granules.

4. The invention according to claim 1 in which said carbon dioxide absorption means comprises powdered soda-lime affixed directly to said internal side of said non-porous shielding means.

5. The surgical mask barrier apparatus according to claim 1 in which the invention further includes moisture detection means operably positioned juxtaposed to said internal side of said substantially non-porous shielding means, for detecting and providing indication of excessive levels of accumulated moisture in said conventional surgical respiratory mask, wherein said excessive levels of accumulated moisture may if undetected and uncorrected potentially promote transport of said infectious hazardous material and infect said wearer.

6. The invention according to claim 5 in which said moisture detection means is affixed to said internal side of said substantially non-porous shielding means.

7. The invention according to claim 5 in which said moisture detecting means changes color when excessive levels of moisture are detected upon said conventional surgical respiratory mask, so as to provide visual indication of said excessive levels of accumulated moisture.

8. The invention according to claim 1, in which said air velocity intensifying means comprises helical shaped channels, one end of which terminates at the periphery of said substantially non-porous shielding means.

9. The invention according to claim 5 in which said substantially non-porous shielding means consists of a substantially transparent material for permitting the visual inspection of the moisture detecting means, toward ascertaining said excessive levels of accumulated moisture to permit the correction of said excessive moisture.

10. The invention according to claim 1 in which a desiccant which serves to absorb moisture is saturated into the material of which said substantially non-porous shielding means is made.

11. The invention according to claim 1 in which said substantially non-porous shielding means consists of clear polypropinate.

12. The invention according to claim 1 in which said substantially non-porous shielding means consists of polystyrene.

13. The invention according to claim 1 in which said substantially non-porous shielding means consists of polycell urethane foam into which a desiccant is saturated.

14. The invention according to claim 1 in which said spacing means consists of ridge means formed into said substantially non-porous shielding means for cooperation and abutment with structural ridges of said conventional surgical respiratory mask to thereby form said air passages.

15. The invention according to claim 1 in which said positioning means comprises a resilient band having a first end and a second end, where said ends are respectively affixed to opposite peripheral positions of said substantially non-porous shielding means without puncturing said substantially non-porous shielding means to preclude the possibility of seepage of a contaminated fluid at such a puncture, said resilient band being positionable around said wearer's head for retaining said substantially non-porous shielding means in juxtaposition with said conventional surgical respiratory mask.

16. The invention according to claim 14 in which said ridge means further comprises a series of ridges forming spaced apart high points and spaced apart low points with each of said high points formed into said substantially non-porous shielding means being intermediate respective ones of said low points formed into said substantially non-porous shielding means, said structural ridges of said conventional surgical respiratory mask having high points and low points with each of said high points of said structural ridges of said conventional surgical respiratory mask being intermediate respective ones of said low points of said structural ridges of said conventional surgical respiratory mask, said low points of said ridge means formed into said substantially non-porous shielding means being operably positioned opposite said high points of said structural ridges of said conventional surgical respiratory mask and said high points of said ridge means formed into said non-porous shielding means being operably positioned opposite said low points of said structural ridges of said conventional surgical respiratory mask to thereby form said air passages.

17. The surgical mask barrier apparatus according to claim 1 in which the invention further comprises lip means formed at a lower periphery of said external side of said non-porous shielding means so that fluid splashed onto said external surface will not inadvertedly find its way to said internal side of said substantially non-porous shielding means.

* * * * *